US005924489A

United States Patent [19]

Hatcher

[11] Patent Number: 5,924,489

[45] Date of Patent: Jul. 20, 1999

[54] METHOD OF SEVERING A DOWNHOLE PIPE IN A WELL BOREHOLE

[76] Inventor: Wayne B. Hatcher, P.O. Box 305, Harvey, La. 70059-0305

[21] Appl. No.: 08/868,236

[22] Filed: Jun. 3, 1997

Related U.S. Application Data

[63] Continuation-in-part of application No. 29/024,964, Jun. 24, 1994, Pat. No. Des. 363,498, application No. 29/024,965, Jun. 24, 1994, Pat. No. Des. 363,293, application No. 29/024,966, Jun. 24, 1994, Pat. No. Des. 363,499, application No. 29/024,967, Jun. 24, 1994, Pat. No. Des. 363,292, and application No. 08/519,916, Aug. 28, 1995, abandoned.

[51] Int. Cl.[6] ..... E21B 29/06

[52] U.S. Cl. ..... 166/298; 166/55; 166/63

[58] Field of Search ..... 166/55, 298, 63

[56] References Cited

U.S. PATENT DOCUMENTS

| | | | |
|---|---|---|---|
| 2,436,036 | 2/1948 | Defenbaugh | 166/55 |
| 2,918,125 | 12/1959 | Sweetman | 166/55 X |
| 3,087,546 | 4/1963 | Woolley | 166/98 X |
| 3,227,214 | 1/1966 | Whann | 166/301 X |
| 3,318,395 | 5/1967 | Messmer | 166/297 X |
| 3,461,964 | 8/1969 | Venghiattis | 166/297 |
| 3,684,008 | 8/1972 | Garrett | 166/55 |
| 4,134,453 | 1/1979 | Love et al. | 166/55 X |
| 4,352,397 | 10/1982 | Christopher | 166/297 |
| 4,703,802 | 11/1987 | Bryan et al. | 166/98 X |
| 4,799,829 | 1/1989 | Kenny | 166/297 X |
| 4,819,728 | 4/1989 | Lafitte | 166/55 X |
| 5,287,920 | 2/1994 | Terrell | 166/63 |

*Primary Examiner*—Hoang C. Dang
*Attorney, Agent, or Firm*—George A. Bode; Lisa D. Charouel; Bode & Associates

[57] ABSTRACT

A method of severing a downhole pipe for forming a region in the well borehole devoid of downhole pipe for enhancing the performance of a perforating gun comprising the steps of: severing, at an angle, by a first cutting tool the downhole pipe to form an upper downhole pipe portion and a lower downhole pipe portion to form a sloped cut line; releasing potential energy stored in the upper downhole pipe portion and the lower downhole pipe portion; inserting a plug to seal an up-hole portion of the upper downhole pipe portion; cutting the up-hole portion via a second cutting tool above the plug into an upper piece and a lower piece; and, jettisoning the lower piece downwardly wherein as the lower piece jettisons downwardly the region in the well borehole devoid of downhole pipe is formed. Such method eliminates the need for: removing a well head; a crane or rig for raising a cut up-hole pipe; and, a pump for controlling the pressure of the well.

11 Claims, 10 Drawing Sheets

METHOD OF SEVERING A DOWNHOLE PIPE IN A WELL BOREHOLE

This application is a continuation-in-part application of previous applications by the same inventor bearing U.S. Ser. Nos. 29/024,964 (now U.S. Design Pat. No. 363,498); No. 29/024,965 (now U.S. Design Pat. No. 363,293); No. 29/024,966 (now U.S. Design Pat. No. 363,499); and, No. 29,024,967 (now U.S. Design Pat. No. 363,292) all of which were filed Jun. 24, 1994. This application is also a continuation-in-part of U.S. Ser. No. 08/519,916, filed Aug. 28, 1995, now abandoned. The entire previous applications bearing U.S. Ser. Nos. 29/024,964 (now U.S. Design Pat. No. 363,498); No. 29/024,965 (now U.S. Design Pat. No. 363,293); No. 29/024,966 (now U.S. Design Pat. No. 363, 499); No. 29,024,967 (now U.S. Design Pat. No. 363,292); and, 08/519,916 are incorporated herein by reference as if set forth in full below.

BACKGROUND OF THE INVENTION

1. Field of the Invention

The present invention relates to several apparatuses for severing pipe and a method for severing pipe, and more particularly to apparatuses for severing downhole pipe and a method of severing downhole pipe to form a region in the well borehole devoid of downhole pipe for enhancing the performance of a perforating gun wherein such method eliminates the need for 1) removing a well head; 2) a crane or rig for raising a cut up-hole pipe; and, 3) a pump for controlling the pressure of the well.

2. General Background

Directional or vertical well boreholes are drilled to high pressure zones in the earth wherein such high pressure zones contain oil or gas. As is known, the well borehole has set therein a tubular casing. After the tubular casing is set, cement is pumped downwardly until such cement reaches the lowermost edge of the tubular casing. Thereafter, the cement flows upward between the outer surface of the tubular casing and the earth for creating a cement barrier between the earth and the tubular casing.

In some instances there are a plurality of oil or gas high pressure zones located at different depths. For exemplary purposes, a first high pressure zone may be located at 10,000 feet and a second high pressure zone may be located at 5,000 feet. In practice, a perforating gun, such as a 4 inch perforating gun, is lowered to the first high pressure zone located at 10,000 feet and shot. The projectile exiting the perforating gun of 4 inches usually provides a clear path to the high pressure zone and especially to a full potential reservoir in the high pressure zone. Thereafter, to prevent the uncontrolled spurting of the oil, exiting the first high pressure zone, at the earth's surface, the pressure in the well borehole is controlled under hydrostatic pressure.

The hydrostatic pressure is replaced with a cement packer to seal the well borehole located at a predetermined distance above the first high pressure zone but below the second high pressure zone located at 5,000 feet and a downhole pipe which extends from the earth's surface to below the packer. Therefore, the oil can be conveyed from the first high pressure zone located at 10,000 feet to the earth's surface via the downhole pipe.

After, the high pressure zone located at 10,000 feet is depleted, it is highly desirable to access the second high pressure zone located at 5,000 feet. Moreover, after the well borehole was drilled, other high pressure zones may have been determined which can also be accessed after the first high pressure zone located at 10,000 feet has been depleted. To access the second high pressure zone located at 5,000 feet a smaller perforating gun of 1.5 to 2 inches capable of fitting in the downhole pipe is lowered to the location of the second high pressure zone. The perforating gun is shot in the downhole pipe. Therefore, the projectile exiting the perforating gun must penetrate the downhole pipe suspended in the tubular casing, the tubular casing and the cement barrier. As a result, the distance traveled by the projectile exiting the perforating gun is significantly reduced and a clear path to the desire full potential reservoir of the high pressure zone located at 5,000 feet may not be had.

In some instances, if the payload of the high pressure zone is large enough, a more costly process is performed to access the second high pressure zone. This process forms a region in the well borehole devoid of down hole pipe by cutting or severing the downhole pipe and raising the upper portion of the cut downhole pipe via a rig. Since a rig costs approximately $2,000 a day and if the process takes 30 days, then the rig cost alone can be $60,000.

When cutting the downhole pipe in a well borehole, it has been the practice to lower a cutting tool into the downhole pipe to a predetermined location and to then cut or sever the downhole pipe in order to free at least the upper portion of the downhole pipe. However, sometimes the portions of the downhole pipe cut by these devices bindingly contact and cannot be separated. Thus, thy prior art cutting tools are sometimes inadequate to separate the downhole pipe. If the pipe has been properly severed, the pipe above the cut is raised, via a crane or rig, for example, 60 feet. As can be appreciated, said region in the well borehole devoid of downhole pipe has been formed. However, to raise the cut downhole pipe 1) the well head must be broken and removed; 2) a crane or rig must be deployed to raise the cut up-hole pipe; and, 3) a pump is required to control the pressure of the well.

Thereafter, a perforating gun is lowered downhole to the region in the well borehole devoid of downhole pipe. The perforating gun is positioned along the inner surface of the tubular casing and is shot. The projectile exiting the perforating gun perforates the tubular casing and the cement barrier and travels a distance for providing a path to said high pressure zone for access to the oil or gas. Thereafter, the pressure of the high pressure zone is controlled.

Several devices have been patented which are aimed at severing downhole pipe which has become lodged in a well bore and perforating guns.

EP Patent Application No. EP 0481,571-A2 of Halliburton Company teaches perforating guns for downhole well pipe that are placed at multiple levels.

U.S. Pat. No. 2,629,445 issued to John C. Kinley on the application of G. A. Dill and entitled "PIPE SEVERING METHOD AND APPARATUS" teaches a pipe severing method and apparatus that explosively perforates and cuts the pipe in a well.

U.S. Pat. No. 2,896,718 issued to Gulf Oil Corporation on the application of T. A. Kibby and entitled "METHOD AND APPARATUS FOR COMPLETING WELLS" discloses downhole perforating with an apparatus that has attachable supports for stabilization of a chemical cutter.

U.S. Pat. Nos. 4,451,487 and 4,552,234, both issued to Halliburton Company on the application of L. W. Revett, disclose well perforating apparatuses that have angled or inclined firing or perforating hole arrangements circumferentially disposed about the body. The Revett '234 patent further discloses a lower centralizing apparatus.

U.S. Pat. No. 4,799,829 issued to P. M. Kenny and entitled "METHOD AND APPARATUS FOR REMOVING SUBMERGED PLATFORMS" discloses a downhole chemical cutter that cuts piping horizontally, with stabilization means extending radially outwardly from the cutter for stabilizing it in angulated piping.

U.S. Pat. No. 2,918,125 entitled "CHEMICAL CUTTING METHOD AND APPARATUS" teaches a conventional chemical cutter having a discharge head portion coupled to a chemical container portion. The discharge head cuts in a horizontal plane.

U.S. Pat. No. 4,703,802 entitles "CUTTING AND RECOVERY TOOL" is related to a rotary cutter and recovery tool wherein the cutter comprises outwardly-pivoting cutting arms.

Other patents present in the art are U.S. Pat. No. 4,352,397 entitled "METHODS, APPARATUS AND PYROTECHNIC COMPOSITIONS FOR SEVERING CONDUITS"; U.S. Pat. No. 2,680,487 entitled "METHOD AND APPARATUS FOR WELL OPERATIONS EMPLOYING HYDROGEN PEROXIDE"; U.S. Pat. No. 3,706,344 entitled "TUBING CONVEYED PERMANENT COMPLETION METHOD AND DEVICE"; and U.S. Pat. No. 4,960,171 entitled "CHARGE PHASING ARRANGEMENTS IN A PERFORATING GUN"; all of which are directed to cutting downhole pipe, but do not meet the needs of the apparatus and method of the present invention.

Thus, a need exists for a first cutting tool for severing a downhole pipe, at an angle, to maximize the release of the potential energy stored in the severed downhole pipe located in a directional or vertical well borehole; a separating tool for separating bindingly contacted portions of a severed downhole pipe by facilitating the release of such stored potential energy; an insertable plug for sealing a portion of the upper downhole pipe portion; and, a second cutting tool for severing above the plug the plugged upper downhole pipe portion and jettisoning downward the severed bottom portion of the plugged upper downhole pipe portion.

Moreover, there exits a need for a weight biasing assembly for orientating the first cutting tool and the separating tool in the well borehole.

Furthermore, there is a need for a method of severing downhole pipe to form a region in the well borehole devoid of downhole pipe for enhancing the performance of a perforating gun wherein such method eliminates the need for 1) removing a well head; 2) a crane or rig for raising a cut up-hole pipe; and, 3) a pump for controlling the pressure of the well.

Regarding the method of severing a downhole pipe, there is a need for a method of severing a downhole pipe to form a region in the well borehole devoid of downhole pipe which comprises cutting the downhole pipe, at an angle, by a first cutting tool for maximizing the release of the stored potential energy, along the cut, by a upper downhole pipe portion and a lower downhole pipe portion; releasing the stored potential energy along the cut; releasing unexpended stored potential energy of bindingly contacted portions of the downhole pipe, by a separating tool; inserting a plug in the upper downhole pipe portion for sealing a portion of the upper downhole pipe portion; cutting the pipe above said plug via a second cutting tool; and, jettisoning downward the severed bottom portion of the plugged upper downhole pipe portion wherein such severed pipe portion becomes somewhat parallel aligned with the bottom downhole pipe portion to create a region in the well borehole devoid of downhole pipe.

SUMMARY OF THE PRESENT INVENTION

The preferred embodiment of the apparatuses and method of the present invention solves the aforementioned problems in a straightforward and simple manner. What is provided is a first cutting tool for severing a downhole pipe, at an angle, to maximize the release of the potential energy stored in the severed downhole pipe located in a directional or vertical well borehole; a separating tool for separating bindingly contacted portions of a severed downhole pipe by facilitating the release of such stored potential energy; an insertable plug for sealing a portion of the upper downhole pipe portion; and, a second cutting tool for severing above the plug the plugged upper downhole pipe portion and jettisoning downward the severed bottom portion of the plugged upper downhole pipe portion.

Further provided is a weight biasing assembly for orientating the first cutting tool and the separating tool in the well borehole.

What is still further provided is a method of severing downhole pipe to form a region in the well borehole devoid of downhole pipe for enhancing the performance of a perforating gun wherein such method eliminates the need for 1) removing a well head; 2) a crane or rig for raising a cut up-hole pipe; and, 3) a pump for controlling the pressure of the well.

Regarding the method of severing a downhole pipe, the method of severing a downhole pipe forms a region in the well borehole devoid of downhole pipe which comprises cutting the downhole pipe, at an angle, by a first cutting tool for maximizing the release of the stored potential energy, along the cut, by a upper downhole pipe portion and a lower downhole pipe portion; releasing the stored potential energy along the cut; releasing unexpended stored potential energy of bindingly contacted portions of the downhole pipe, by a separating tool; inserting a plug in the upper downhole pipe portion for sealing a portion of the upper downhole pipe portion; cutting the pipe above said plug via a second cutting tool; and, jettisoning downward the severed bottom portion of the plugged upper downhole pipe portion wherein such severed pipe portion becomes somewhat parallel aligned with the bottom downhole pipe portion to create a region in the well borehole devoid of downhole pipe.

The method of the present invention includes the steps of:

(a) severing, at an angle, the downhole pipe to form a upper downhole pipe portion and a lower downhole pipe portion to form a sloped cut line;

(b) releasing potential energy stored in the upper downhole pipe portion and the lower downhole pipe portion;

(c) inserting a plug to seal a up-hole portion of the upper downhole pipe portion;

(d) cutting the up-hole portion via a second cutting tool above said plug into a upper piece and a lower piece; and, (e) jettisoning the lower piece downward wherein as the lower piece jettisons downward the region in the well borehole devoid of downhole pipe is formed.

In view of the above, it is an object of the present invention to provide a method for severing downhole pipe which severs the downhole pipe at a predetermined angle $\alpha$ to form a sloping cut line in a directional or vertical well borehole wherein such cut line is maximally oriented on the downhole pipe and the slope of the cut line is maximized. The maximized orientation and the maximized slope of the cut line serve to 1) maximize the effect of gravitational forces acting on the severed downhole pipe, in the well borehole, to facilitate the release of stored potential energy; 2) maximize the full release of stored potential energy between the upper downhole pipe portion and the lower downhole pipe portion along said cut line; and, 3) maximizing the effect of the expansion properties of the cut downhole pipe to facilitate the parallel alignment of the upper downhole pipe portion from the lower downhole pipe portion.

Another object of the present invention is to provide a severing head which is capable of forming a sloped cut line in the downhole pipe.

A further object of the present invention is to provide a weight biasing assembly which orients the severing head to orient the sloping cut line having predetermined angle $\alpha$ to 1) maximize the effect of gravitational forces acting on the severed downhole pipe, in the well borehole, to facilitate the release of stored potential energy. The weight biasing assembly further prevents the uncontrolled twisting and turning of the first cutting tool as the first cutting is lowered in the well borehole via a wireline.

It is a still further object of the present invention to provide a separating tool capable producing a sufficient force to release the unexpended potential energy stored in the upper downhole pipe portion and the lower downhole pipe portion if they bindingly contact.

It is a still further object of the present invention to provide a weight biasing assembly for controlling the orientation of a separating tool into the upper downhole pipe portion and the lower downhole pipe portion which are bindingly contacted and may have shifted along the sloped cut line.

It is a still further object of the present invention to provide a second cutting tool capable of providing a sufficient force to server the plugged upper downhole pipe portion and jettison downward the severed bottom portion of the plugged upper downhole pipe portion.

It is a further object of the present invention to provide such a severing head for severing downhole pipe which has staggered stabilizers in different planes along the outer perimeter of such severing head wherein such staggered stabilizers centers the severing head to maximize the slope of the cut line formed in the downhole pipe.

It is a further object of the present invention to provide such a second cutting tool for severing downhole pipe which has stabilizers spaced 60° apart and staggered in different planes along the outer perimeter of such second cutting tool.

In view of the above objects it is a feature of the present invention to provide apparatuses for severing downhole pipe which are simple in design and easy and economical to manufacture.

It is another feature of the present invention to provide a method for severing downhole pipe for creating a region in the well borehole devoid of downhole pipe which is simple and inexpensive to execute.

The above and other objects and features of the present invention will become apparent from the drawings, the description given herein, and the appended claims.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
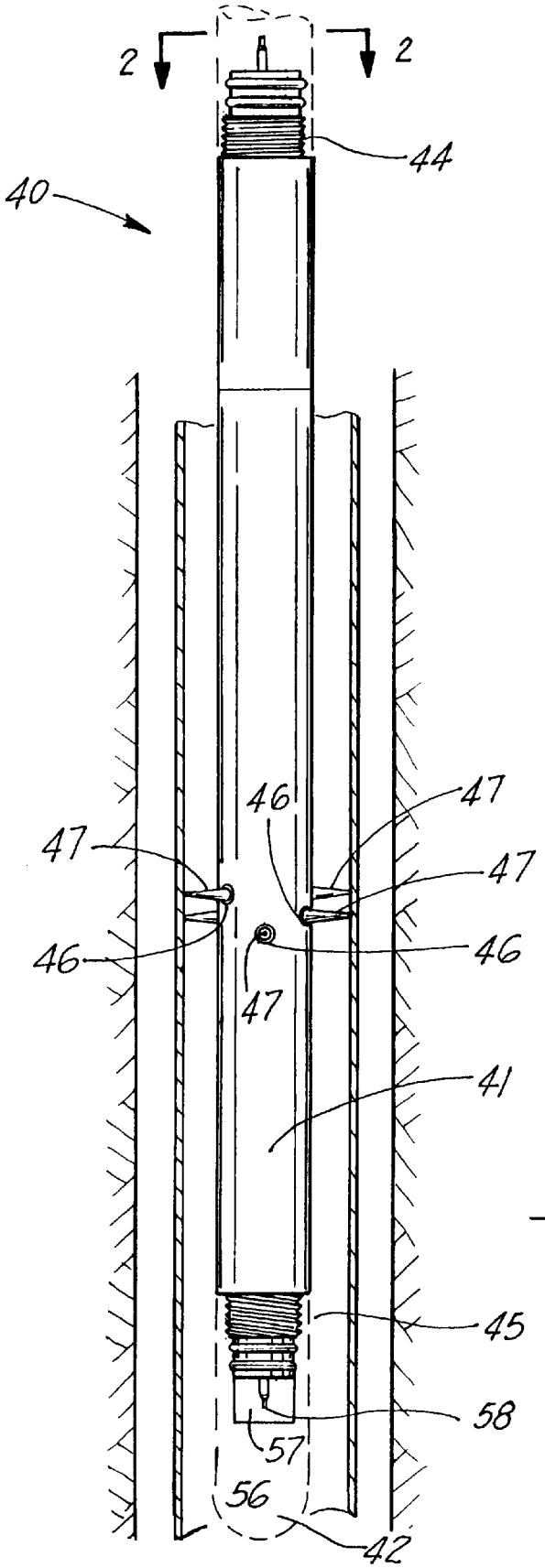
FIG. 1 is a side view of the preferred embodiment of the second cutting tool of the present invention illustrated as positioned in the upper downhole pipe portion, with the top and the bottom portions of the second cutting tool shown in PHANTOM.

Referring now to the drawings, and in particular FIGS. 1–9 and 10*a*–10*d,* the apparatuses of the present invention are used to carry out the method of severing downhole pipe P for producing a region R in the well borehole devoid of downhole pipe P for enhancing the performance of a perforating gun (not shown). Such method eliminates the need for 1) removing a well head; 2) a crane or rig for raising a cut up-hole pipe; and, 3) a pump for controlling the pressure of the well.

The apparatuses of the present invention comprises a first cutting tool having severing head 20, separating tool 30, plug G, weight biasing assembly 60 and second cutting tool 40.

Referring now to FIGS. 4–7, said first cutting tool comprises severing head 20 and a standard chemical housing 29 wherein in the preferred embodiment said first cutting tool is a chemical cutter. Chemical cutters are well known in the art, such as described in U.S. Pat. No. 2,918,125, by Sweetman, which is incorporated herein by reference as if set forth in full below. However, known chemical cutters do not cut on an angle. Therefore, severing head 20 is designed to cut down hole pipe on an angle. My severing head can be adapted to couple to a myriad of standard chemical housings. Chemical cutters are preferred since chemical cutters are capable of producing a smoother cut in downhole pipe P. Such smoother cut provides the necessary surface-to-surface contact between upper downhole pipe portion U and lower downhole pipe portion L for the separation thereof. Moreover, chemical cutters eliminate bulges or flares in the downhole pipe P and eliminate shock waves which can cause damage to the well borehole structure both of which can be caused by explosives substances.

Severing head 20 comprises housing 21, a plurality of stabilizing means 22*a*, 22*b*, 22*c*, 22*d*, 22*e* and 22*f* and a plurality of severing apertures 23 formed in the outer perimeter of housing 21. Housing 21 comprises a cylindrical member having one distal end thereof curved to form curved downhole end 24. The other end of such cylindrical member comprises threaded member 25 for coupling to standard chemical housing 29. Said cylindrical member comprises circumferential recess 26 having formed therein the plurality of severing apertures 23. Said cylindrical member further comprises tapering cylindrical member 27 wherein tapering cylindrical member 27 merges into curved downhole end 24.

Tapering cylindrical member 27 has formed therein a plurality of recessed apertures 28 for receiving therein the plurality of stabilizing means 22*a*, 22*b*, 22*c*, 22*d*, 22*e* and 22*f* which radially project outward from tapering cylindrical member 27. The plurality of recessed apertures 28 are threaded for matingly coupling therein a threaded end (not shown) of the plurality of stabilizing means 22*a*, 22*b*, 22*c*, 22*d*, 22*e* and 22*f*. The plurality of recessed apertures 28 are staggered in different horizontal and vertical planes around tapering cylindrical member 27. Alternatively, the plurality of stabilizing means 22*a*, 22*b*, 22*c*, 22*d*, 22*e* and 22*f* may be circumferentially aligned in lieu of the staggered alignment.

The plurality of stabilizing means 22*a*, 22*b*, 22*c*, 22*d*, 22*e* and 22*f* serve to support substantially centrally housing 21 within downhole pipe P without hindering the lowering or raising of said first cutting tool. Since said first cutting tool must be lowered down downhole pipe P to a predetermined depth, the plurality of stabilizing means 22*a*, 22*b*, 22*c*, 22*d*, 22*e* and 22*f* are made of flexible material, such as, without limitation, rubber-like material, to permit such plurality of stabilizing means 22*a*, 22*b*, 22*c*, 22*d*, 22*e* and 22*f* to flex within downhole pipe P. Furthermore, the plurality of stabilizing means 22*a*, 22*b*, 22*c*, 22*d*, 22*e* and 22*f* are not forced fit within the inner circumference of downhole pipe P. The staggering of the plurality of stabilizing means 22*a*, 22*b*, 22*c*, 22*d*, 22*e* and 22*f* serve to enhance the substantial centralized support of first cutting tool within downhole pipe P. The plurality of stabilizing means 22*a*, 22*b*, 22*c*, 22*d*, 22*e* and 22*f* have a length which may be greater than the inner diameter of downhole pipe P. The flexible material, such as, without limitation, rubber-like material, of the plurality of stabilizing means 22*a*, 22*b*, 22*c*, 22*d*, 22*e* and 22*f* are made of may be easily cut to the dimension of the inner diameter D1 of downhole pipe P while on-site.

The plurality of stabilizing means 22*a*, 22*b*, 22*c*, 22*d*, 22*e* and 22*f* allows severing head 20 to be substantially centered in downhole pipe P. Therefore, the angled cut formed by severing head 20 can be maximized, especially in a directional well borehole having forces of gravity acting thereon to force severing head 20 toward the low side surface of downhole pipe P. Nevertheless, the plurality of stabilizing means 22*a*, 22*b*, 22*c*, 22*d*, 22*e* and 22*f* are optional but preferred. Furthermore, the attachable/detachable properties of the plurality of stabilizing means 22*a*, 22*b*, 22*c*, 22*d*, 22*e* and 22*f* does not hinder the transportability or storage of severing head 20 since the plurality of stabilizing means 22*a*, 22*b*, 22*c*, 22*d*, 22*e* and 22*f* may be attached and detached on-site.

Figure 4:
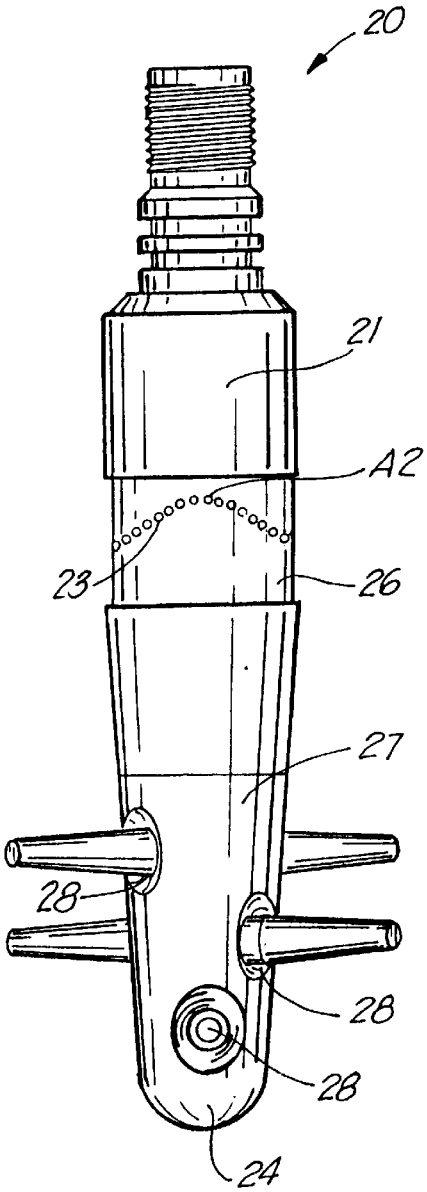
FIG. 4 is a rear elevational view of the angled severing head of the preferred embodiment of the present invention.
Figure 5:
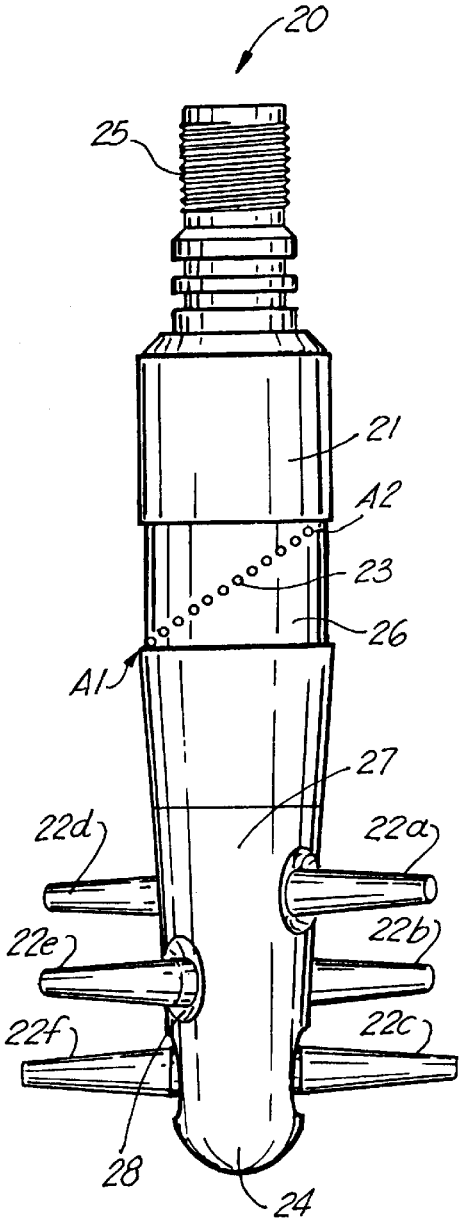
FIG. 5 is a left side elevational view of the angled severing head of the preferred embodiment of the present invention.
Figure 6:
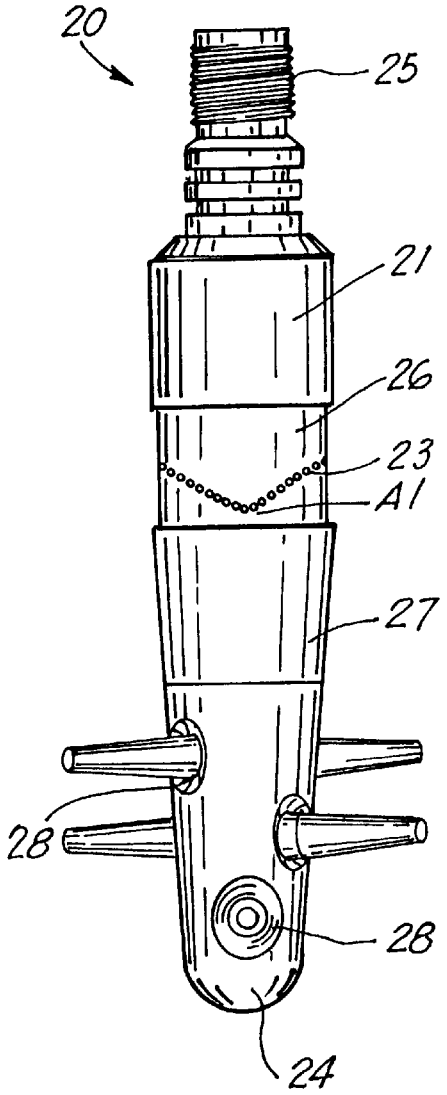
FIG. 6 is a front elevational view of the angled severing head of the preferred embodiment of the present invention.
Figure 11:
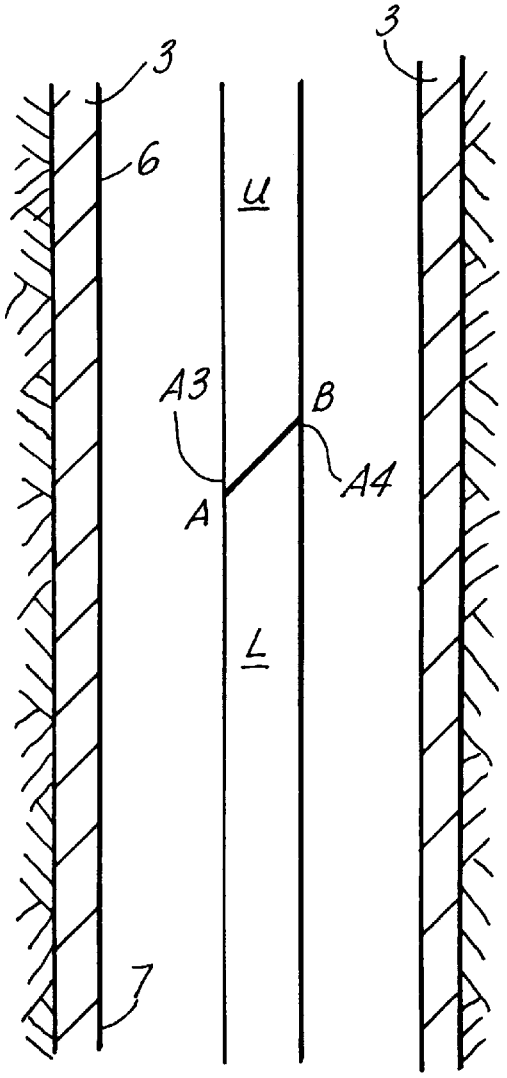
FIG. 11 is a view of the downhole pipe cut along line A–B of the present invention.
Figure 7:
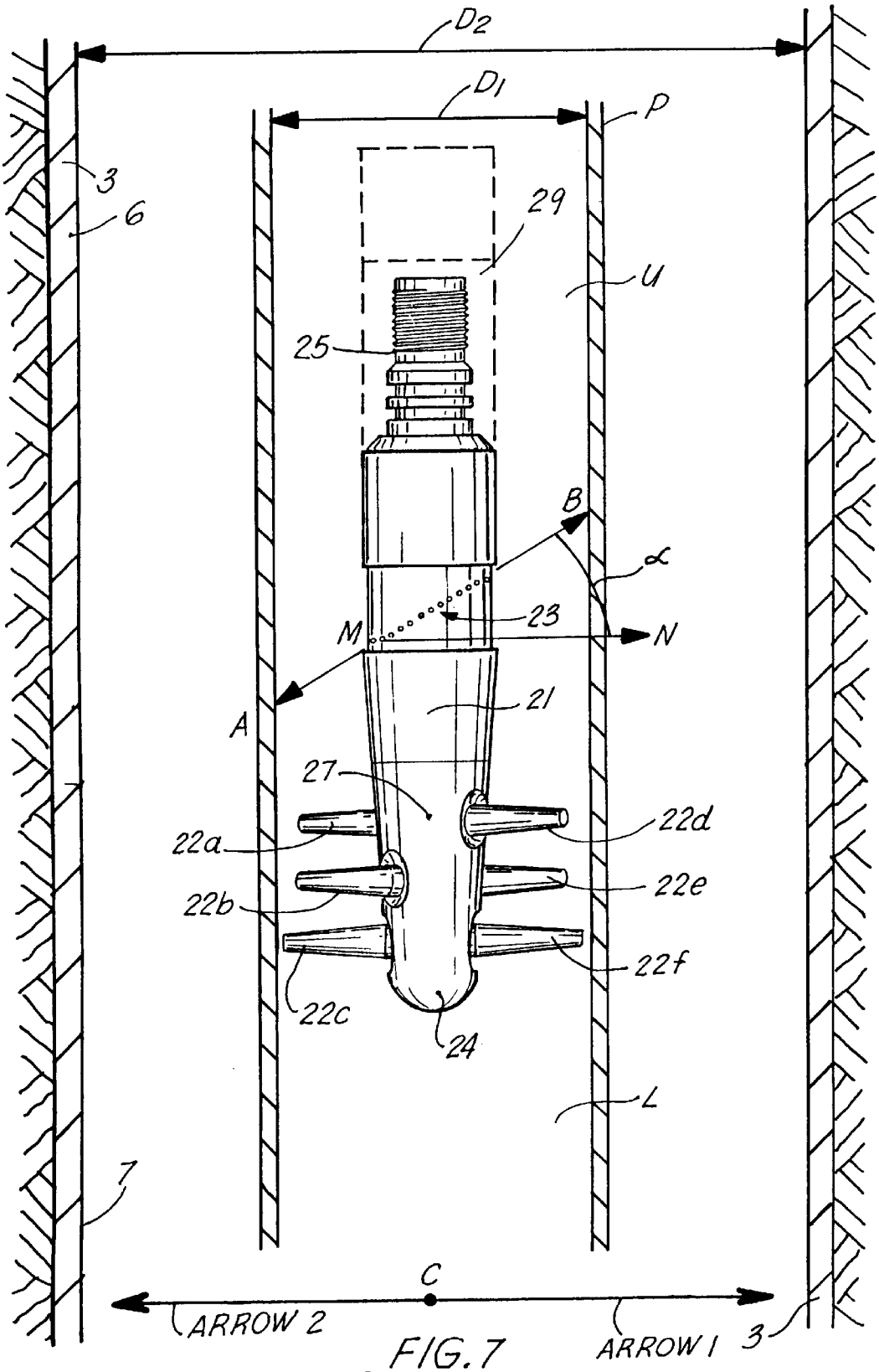
FIG. 7 is a right side elevational view of the angled severing head of the preferred embodiment of the present invention suspended in the downhole pipe of the well borehole.

The plurality of severing apertures 23 are aligned in two parallel sloping curved lines (hereinafter referred to as cut line A–B) which juncture at low point apex A1 and high point apex A2. The front of housing 21 peaks at low point apex A1, as best seen in FIG. 6, wherein from low point apex A1 the two sloping curved lines wrap around housing 21, as best seen in FIG. 5, and peak at high point apex A2 in the back of housing 21, as best seen in FIG. 4. The front of housing 21, as best seen in FIG. 6, and the back of housing 21, as best seen in FIG. 4, are hereinafter referred to as high side and low side, respectively, for a directional well borehole drilled at an angle of inclination. The term low side of the directional well borehole is taken to represent that region in the well borehole in which gravitational forces act on the downhole pipe P in the direction of ARROW 1. Therefore, for illustrative purposes the high side is to the left of center point C, as indicated by ARROW 2, and the low side is to the right of center point C, as indicated by ARROW 1. The low side and the high side of the well borehole are not to be confused with the longitudinal directions of up and down in the well borehole.

The plurality of severing apertures 23 expel therefrom a volatile substance, such as, without limitation, bromine trifluoride, for cutting or severing downhole pipe P at a predetermined angle a wherein predetermined angle $\alpha$ is within the range of 20 to 80°. The predetermined angle $\alpha$ produces said two parallel sloping curved lines which juncture at low point apex A1 and high point apex A2. The slope formed by predetermined angle $\alpha$ should be selected in relation to the angle of inclination of the well borehole such that the slope of cut line A–B in combination with the angle of inclination of the well borehole maximizes the release of stored potential energy in severed downhole pipe P. More specifically, the angle of inclination of the well borehole is taken to represent a vertical line. Predetermined angle $\alpha$ is formed with respect to cut line A–B and line M–N perpendicular to said vertical line. Therefore, cut line A–B forms upper downhole pipe portion U and lower downhole pipe portion L wherein along cut line A–B a portion of upper downhole pipe portion U overlaps a portion of lower downhole pipe portion L.

Figure 12:
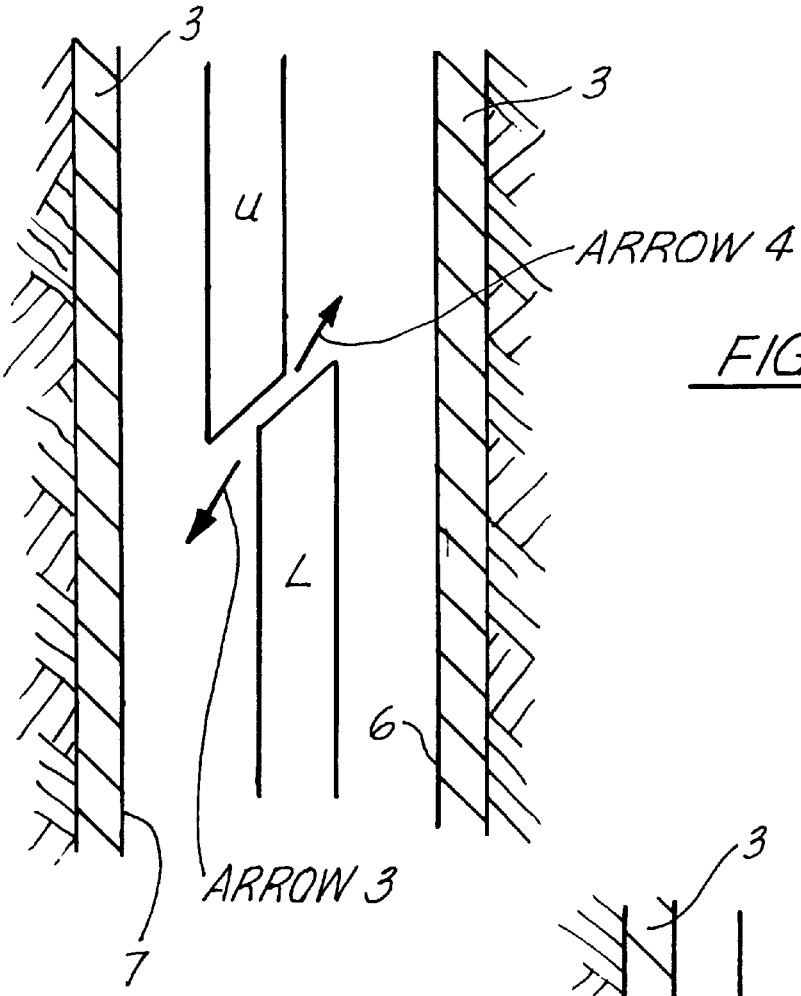
FIG. 12 is a view of the upper downhole pipe portion and the lower downhole pipe portion releasing stored potential energy.

The length of downhole pipe P while in the well borehole places downhole pipe P in a state of compression. Therefore, as cut line A–B having predetermined angle $\alpha$ is formed, the potential energy stored in the compressed downhole pipe P is released causing the upper downhole pipe portion U and lower downhole pipe portion L to move into an expanding state. The expanding properties of upper downhole pipe portion U caused upper downhole pipe portion U to shift in the direction of ARROW 3, as best seen in FIG. 12. Simultaneously, as upper downhole pipe portion U shifts in the direction of ARROW 3, the expanding state of lower downhole pipe portion L and the gravitational forces acting thereon, especially in a directional well borehole, causes lower downhole pipe portion L to move in the direction of ARROW 4, as best seen in FIG. 12. As can be appreciated, the shifting of lower downhole pipe portion L and upper downhole pipe portion U cannot be had with a horizontal cut. Furthermore, with a horizontal cut, the compression and expanding properties would cause the upper downhole pipe portion U and the lower downhole pipe portion L to bindingly contact and prevent the release of the stored potential energy.

Downhole pipe P, a cylindrical member, is divided into a low side semi-cylindrical portion and a high side semi-cylindrical portion. The low side semi-cylindrical portion is the semi-cylindrical portion which resides in said low side of the well bore hole. The high side semi-cylindrical portion is the semi-cylindrical portion which resides in said high side of the well bore hole. In the preferred embodiment, apex A3 of upper downhole pipe portion U corresponds to low point apex A1 located in the front of housing 21 and apex A4 of lower downhole pipe portion 1 corresponds to high point apex A2 located in the back of housing 21. Furthermore, apex A3 is substantially in the center of the said high side semi-cylindrical portion and apex A4 is substantially in the center of said low side semi-cylindrical portion.

Said first cutting tool comprising severing head 20 is lowered down into the downhole pipe P via a wireline cable to a first predetermined location wherein such first predetermined location is determined based on the location of a high pressure region in the subterranean earth. As said first cutting tool is raised or lowered in downhole pipe P, the wireline cable twists and turns thereby causing the orientation of said first cutting tool to twist and turn in the direction of the twists and turns of the wireline cable. Therefore, the orientation of the plurality of severing apertures 23 cannot be determined with any degree of estimate much less any degree of accuracy. Therefore, said first cutting tool will not cut or sever downhole pipe P at predetermined angle a such that apex A3 is substantially in the center of said high side semi-cylindrical portion and apex A4 is substantially in the center of the low side semi-cylindrical portion. Therefore, the orientation of first cutting tool 20 must be controlled so that said first cutting tool will cut or sever downhole pipe P at predetermined angle a such that apex A3 is substantially in the center of the high side semi-cylindrical portion and apex A4 is substantially in the center of the low side semi-cylindrical portion.

Referring now to FIGS. 10*a*–10*d,* said first cutting tool has coupled thereto weight biasing assembly 60 wherein weight biasing assembly 60 serves to orient said first cutting tool in a predetermined direction in a downhole pipe P regardless of the twisting and turning of the wireline cable as the wireline cable is either spooled or un-spooled to raise or lower said first cutting tool.

Weight biasing assembly 60 comprises a geometrically shaped member having a first portion 61 made of a first material having a first weight and a second portion 62 made of a second material having a second weight. Said first weight is significantly heavier than said second weight. Each distal end 63 and 64 of said geometrically shaped member is threaded for coupling to an optional flexural mounting 1 and said first cutting tool having severing head 20 via an optional flexural mounting 1', respectively. Furthermore, each distal end 63 and 64 have coupled thereto electrical conductor couplers 69 and 69', respectively.

Weight biasing assembly 60 further comprises rotating swivel means 65 coupled to the up-hole distal end 63 of said geometrically shaped member. Rotating swivel means 65 serves to allow said geometrically shaped member to freely rotate into said predetermined position as said wireline cable twists and turns. The down-hole distal end 64 of said geometrically shaped member is rigidly coupled to said first cutting tool via adjustment collar member 66.

Adjustment collar member 66 allows said first cutting tool to be coupled to said geometrically shaped member such that apex A1 is located in the center of second portion 62 and apex A2 is located in the center of first portion 61.

Figure 10A:
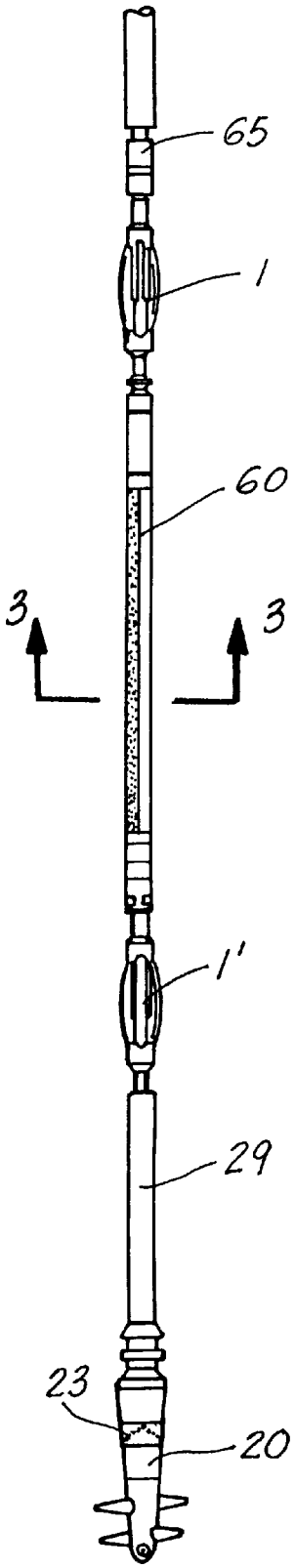
FIG. 10*a* is a view of the weight biasing assembly coupled to the first cutting tool having severing head 20.
Figure 10B:
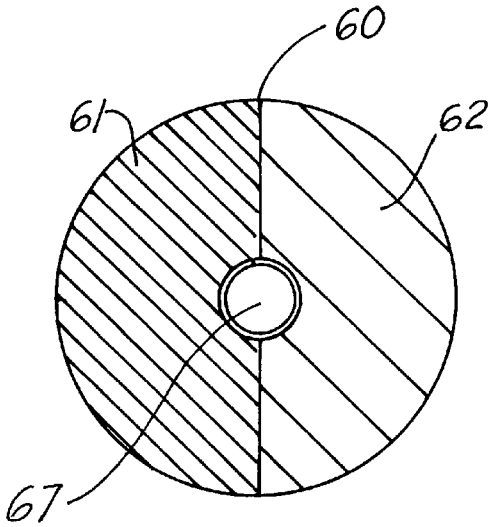
FIG. 10*b* is a cross-sectional view of the geometrically shape member of the weight biasing assembly along the plane of 3—3 in FIG. 10*a;*
Figure 10C:
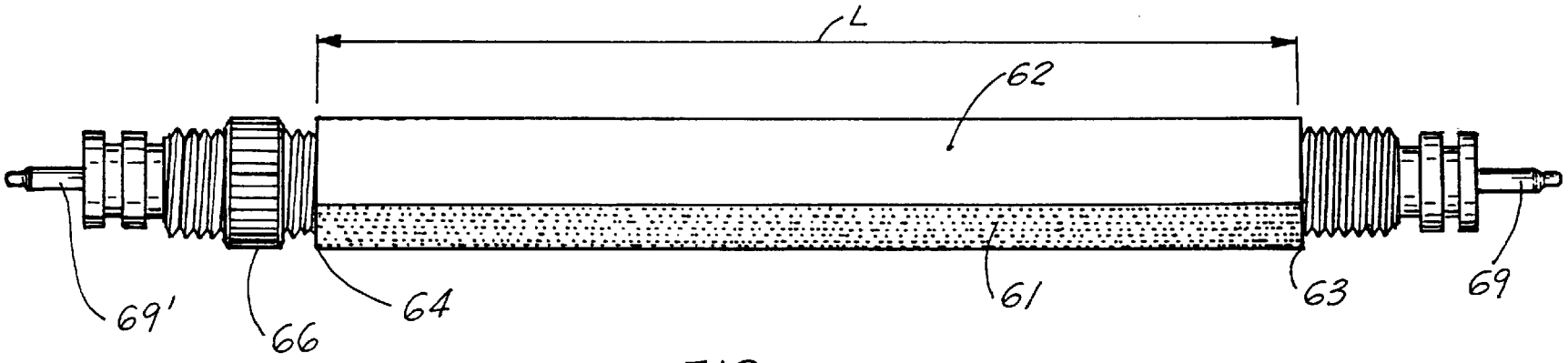
FIG. 10*c* is a view of the geometrically shaped member of the weight biasing assembly.

The combination of the length L of said geometrically shaped member, the diameter and the weight of first portion 61 distributed along length L provides a sufficient biasing force to orient severing head 20 of said first cutting tool in a predetermined position. Due to the force of gravity and the angle of inclination of the well borehole, weight biasing assembly 60 is biased such that length L of first portion 61 always rotates into the low side semi-cylindrical region thereby orientating the plurality of severing apertures 23 to substantially center high point apex A2 in the low side semi-cylindrical region and to substantially center low point apex A1 in said high side semi-cylindrical region. The center of said geometrically shaped member has formed therein hollow passage 67, as best seen in FIG. 10*b,* for passing therethrough the an electrical conductor (not shown) to said first cutting tool. In the exemplary embodiment, the geometrical shape of said geometrically shaped member is cylindrical and first portion 61 and second portion 62 are semi-cylindrical. However, any geometrical shape having a first portion with a first weight and a second portion with a second weight, such that the gravitational forces action on the first portion controls the orientation of such geometrical shape into a predetermined position, may be substituted. In the preferred embodiment, said first material is lead and said second material is aluminum. Nevertheless, said first material and said second material may be any such material which provides for a significant weight differential between the two materials. Additionally, in lieu of two separate materials first portion 61 may be solid and second portion 62 may be hollow.

Weight biasing assembly 60 orients severing head 20 to orient the sloping cut line A–B having predetermined angle $\alpha$ to 1) maximize the effect of gravitational forces acting on the severed downhole pipe P, in the well borehole, to facilitate the release of stored potential energy. weight biasing assembly 60 further prevents the uncontrolled twisting and turning of said first cutting tool as said first cutting is lowered in the well borehole via a wireline.

Weight biasing assembly 60 coupled to said first cutting tool orients the plurality of severing apertures 23 in a predetermined orientation wherein as the plurality of severing apertures 23 cut and sever downhole pipe P upper portion U and lower portion L are formed. After weight biasing assembly 60 orients the plurality of serving apertures 23 in said predetermined orientation, first cutting tool 20 is activated to sever downhole pipe P to form predetermined angle $\alpha$. Thereafter, upper downhole pipe portion U will begin to shift in the direction of ARROW 3, as best seen in FIG. 12. As upper downhole portion U begins to shift the lower downhole pipe portion L begins to expand and shifts in the direction of ARROW 4, as best seen in FIG. 12.

The method for severing downhole pipe, of the present invention, severs the downhole pipe at a predetermined angle $\alpha$ to form sloping cut line A–B in a directional or vertical well borehole wherein such cut line A–B is maximally oriented on the downhole pipe and the slope of the cut line is maximized. The maximized orientation and the maximized slope of the cut line serve to 1) maximize the effect of gravitational forces acting on the severed downhole pipe, in the well borehole, to facilitate the release of stored potential energy; 2) maximize the full release of stored potential energy between the upper downhole pipe portion and the lower downhole pipe portion along said cut line;

and, 3) maximizing the effect of the expansion properties of the cut downhole pipe to facilitate the parallel alignment of the upper downhole pipe portion from the lower downhole pipe portion.

Downhole pipe P has a diameter D1, typically, in the range of 2–3 inches. Tubular casing 6, surrounded by cement barrier 3, has an inner diameter D2, typically, in the range of 7–9 inches. Therefore, as lower downhole portion L expands and shifts in the direction indicted by ARROW 4, gap G1 is formed between the inner wall 7 of the tubular casing 6 and surface 9 of lower downhole pipe portion L.

Figure 14:
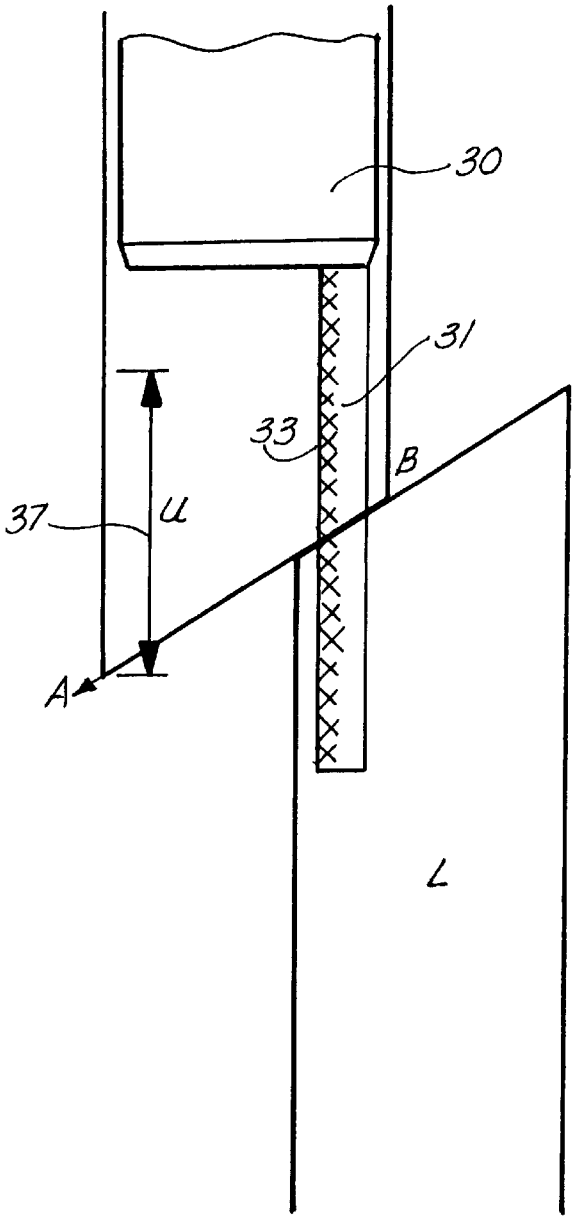
FIG. 14 is a view of the separating tool journalled in the bindingly contacted upper downhole pipe portion and lower downhole pipe portion; and, FIG. 15 is a view of the region in the well borehole devoid of downhole pipe.

The method after severing downhole pipe P to form cut line A–B requires forces of gravity to act upon lower downhole pipe portion L and the effect of the expansion properties of the severed downhole pipe P to urge lower downhole pipe portion L to expand and shift in the direction indicated by ARROW 4. However, in the process of severing, portions of downhole pipe may remain bindingly contacted, as best seen in FIG. 14. This occurs due to a number of factors such as, without limitation, malfunction of said first cutting tool, uneven distribution of the severing chemical or torch produced by said first cutting tool and serration in the cut surface. Moreover, because downhole pipe P is substantially suspended within the well borehole via a cement packer, the movement of lower downhole pipe portion L may be slight.

Figure 13:
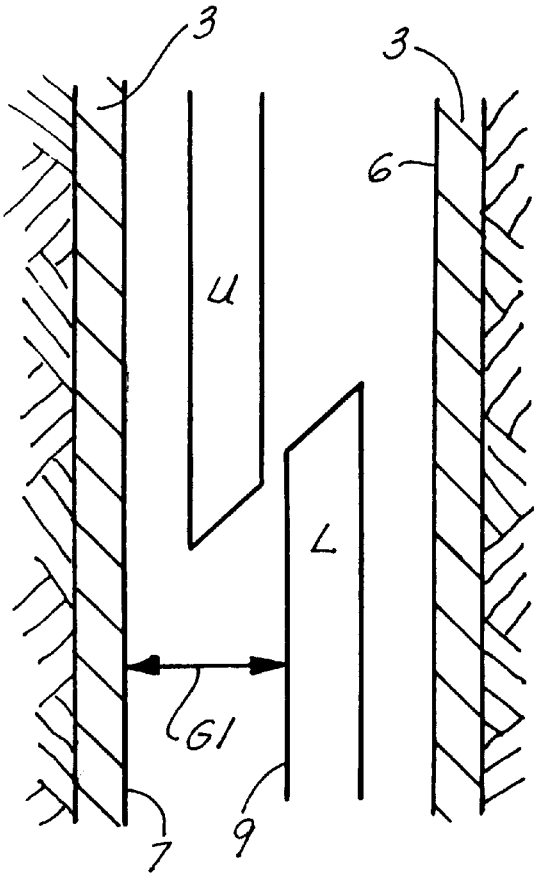
FIG. 13 is a view of the upper downhole pipe portion and the lower downhole pipe portion after the full release of the stored potential energy and the somewhat parallel alignment thereof.

Therefore, for quality assurance to insure the complete severance and separation of upper downhole pipe portion U and lower downhole pipe portion L, as best seen in FIG. 13 and to ensure lower downhole pipe portion L moves in the direction of ARROW 4, separating tool 30 is used to produced a sufficient force to release unexpended potential energy if upper downhole pipe portion U and lower downhole pipe portion L bindingly contact. Henceforth, upper downhole pipe portion U and lower downhole pipe portion L are offset from center C wherein gap G1 is formed. Gap G1 provides an unobstructed path along lower downhole pipe portion L.

Figure 8:
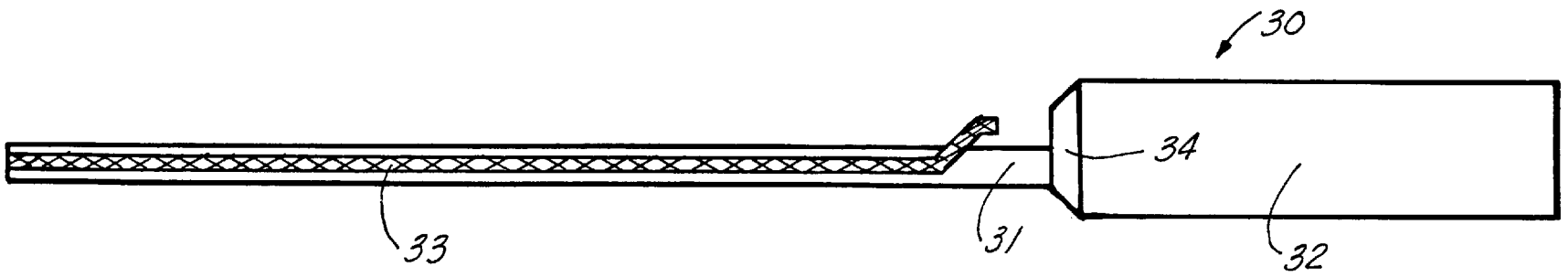
FIG. 8 is a view of the shattering rod of the preferred embodiment of the present invention.
Figure 9:
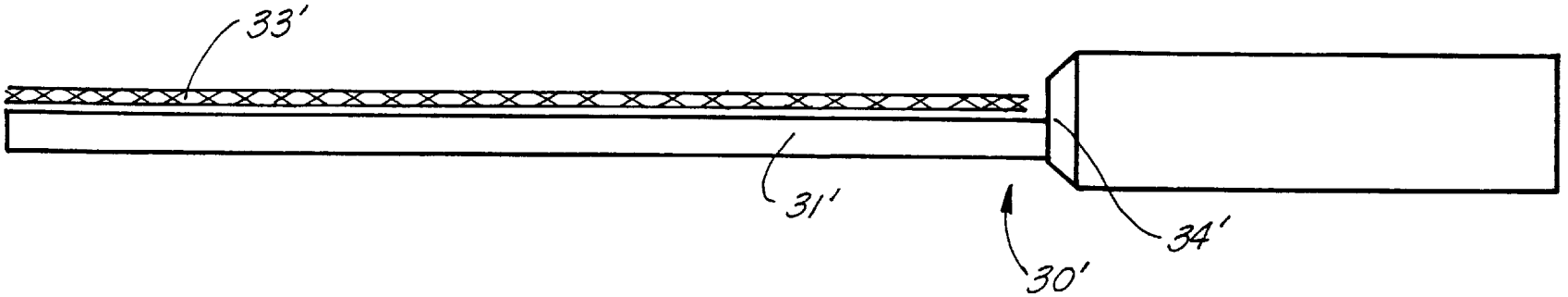
FIG. 9 is a view of an alternative embodiment of the shattering rod of the present invention.

Referring to FIG. 8, separating tool 30 comprises rod member 31, support member 32 and explosive means 33 wherein explosive means 33 produces a sufficient force to release unexpended potential energy in upper downhole pipe portion U and lower downhole pipe portion L. The longitudinal surface of rod member 31 of separating tool 30 may have an interior longitudinal channel formed therein for receiving explosive means 33. As shown in FIG. 9, alternatively, rod member 31' of separating tool 30' may have explosive means 33 affixed to the exterior the longitudinal surface of rod member 31'. Rod member 31 is made of a material which is capable of shattering into a plurality of particles wherein such particles dissipate and/or free fall down lower downhole pipe portion L or into the well borehole. Since rod member 31 shatters into a plurality of particles, rod member 31 will not bindingly contact with upper downhole pipe portion U or lower downhole pipe portion L or hinder the release of unexpended potential energy in upper downhole pipe portion U and lower downhole pipe portion L. As shown in FIG. 14, the shattering of rod member 31 will enable the swift shift of upper downhole pipe portion U in the direction of ARROW 3.

If upper downhole pipe portion U and lower downhole pipe portion L are bindingly contacted, separating tool 30 provides a sufficient force to release the unexpended potential energy in upper downhole pipe portion U and lower downhole pipe portion L to allow upper downhole pipe portion U to unbind the bindingly contact engagement of upper downhole pipe portion U and lower downhole pipe portion L. Henceforth, upper downhole pipe portion U shifts in the direction of ARROW 3. In the exemplary embodiment, rod member 31 is made of fiberglass and explosive means 33 is primacord explosives.

Figure 10D:
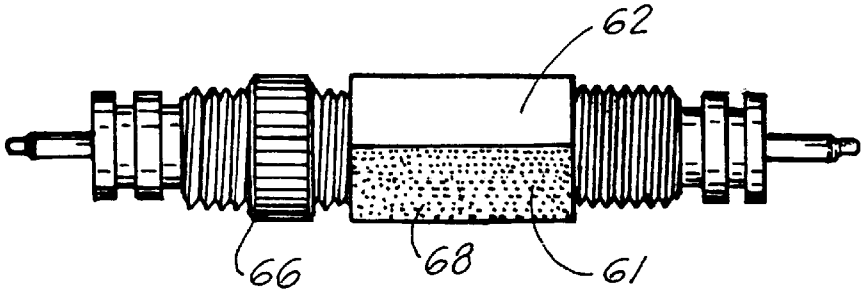
FIG. 10*d* is an alternative embodiment of the geometrically shaped member of the weight biasing assembly.

Support member 32 is a cylindrical member capable of loosely supporting rod member 31 within downhole pipe P such that separating tool 30 is unhindered as it is lowered or raised in downhole pipe P. In the preferred embodiment, base 34 of support member 32 has coupled thereto rod member 31 wherein rod member 31 is offset from the axis of support member 32. Alternatively, rod members 31 or 31' may be coupled in the center of support member 32 or 32', respectively. The interior of support member 32 is threaded (not shown) to coupled to weight biasing assembly 60 wherein weight biasing assembly 60 now uses has a shorter geometrically shaped member 68, as best seen in FIG. 10*d*. As is apparent, controlling the orientation of separating tool 30 allows separating tool 30 to be journalled into upper downhole pipe portion U and lower downhole pipe portion L even if upper downhole pipe portion U and lower downhole pipe portion L have shifted in the direction of ARROW 3 and ARROW 4 and have bindingly contacted, as shown in FIG. 14.

Referring again to the method of severing, of the present invention, separating tool 30 is lowered into downhole pipe P such that a portion of rod member 31 is received in lower downhole pipe portion L and upper downhole pipe portion L, as best seen in FIG. 14. In the preferred embodiment, the offset rod member 31 of separating tool 30 almost abuts the inner surface of lower downhole pipe portion L. Separating tool 30 is ignited and explodes causing the complete the release of unexpended potential energy in upper downhole portion U and lower down hole portion L by quaking the binding contact therebetween. Henceforth, if upper downhole portion U and lower downhole portion L were bindingly contacted, separating tool 30 unbinds upper downhole portion U and lower downhole portion L thereby lower downhole portion L is free to move in the direction of ARROW 4 and upper downhole pipe portion U is free to move in the direction of ARROW 3.

On the other hand if upper downhole pipe portion U and lower downhole pipe portion L have fully released the stored potential energy without becoming bindingly contacted, as shown FIG. 13, separating tool 30 will only explode in the well borehole without hindering the further operations of the present invention.

Referring again to the method of the present invention, separating tool 30 coupled to wireline cable is lowered to region 37 defined by the overlapping portions of upper downhole pipe portion U and lower downhole pipe portion L defined by cut line A–B. Separating tool 30 is ignited and explodes to release the unexpended potential energy for separating the overlapping portions. Thereafter, lower downhole portion L is free expand and shift, as the force of gravity acts thereon.

Figure 3:
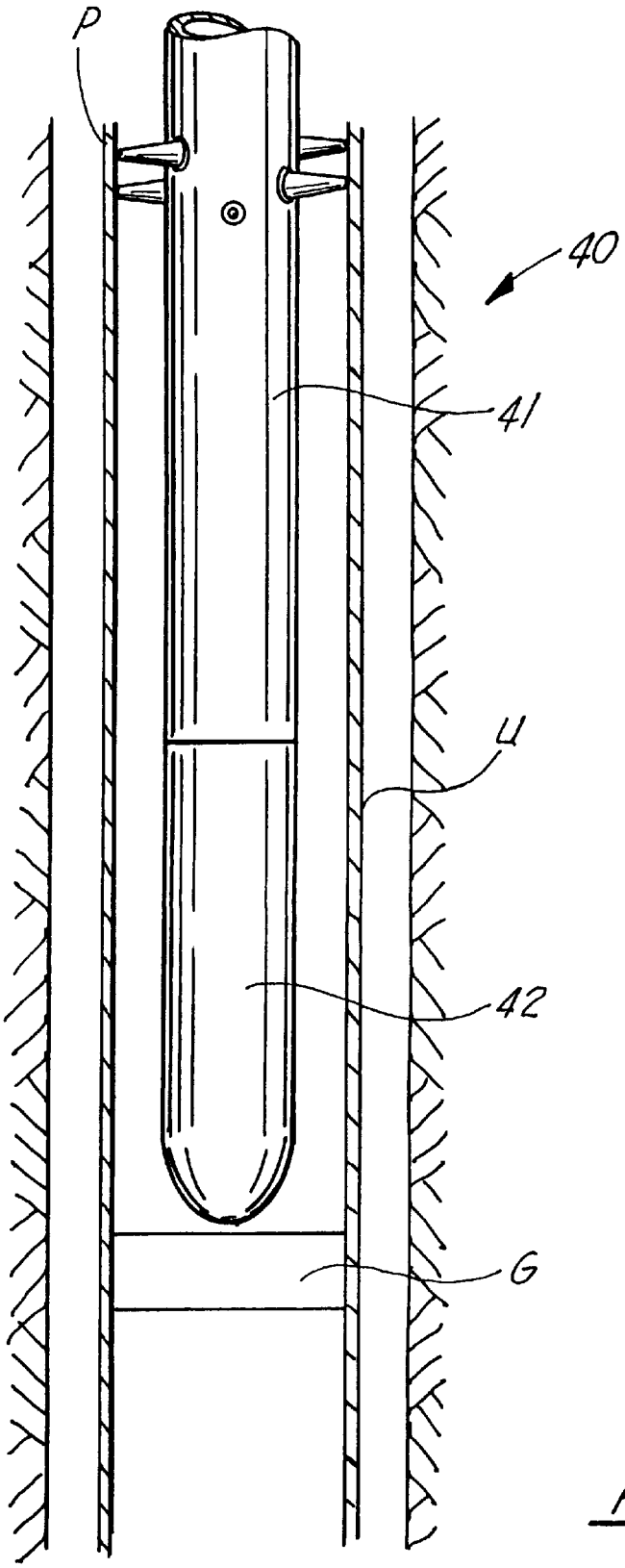
FIG. 3 is a side view of the bottom portion of the embodiment of FIG. 1, wherein the second cutting tool is shown positioned above the set plug.
Figure 15:
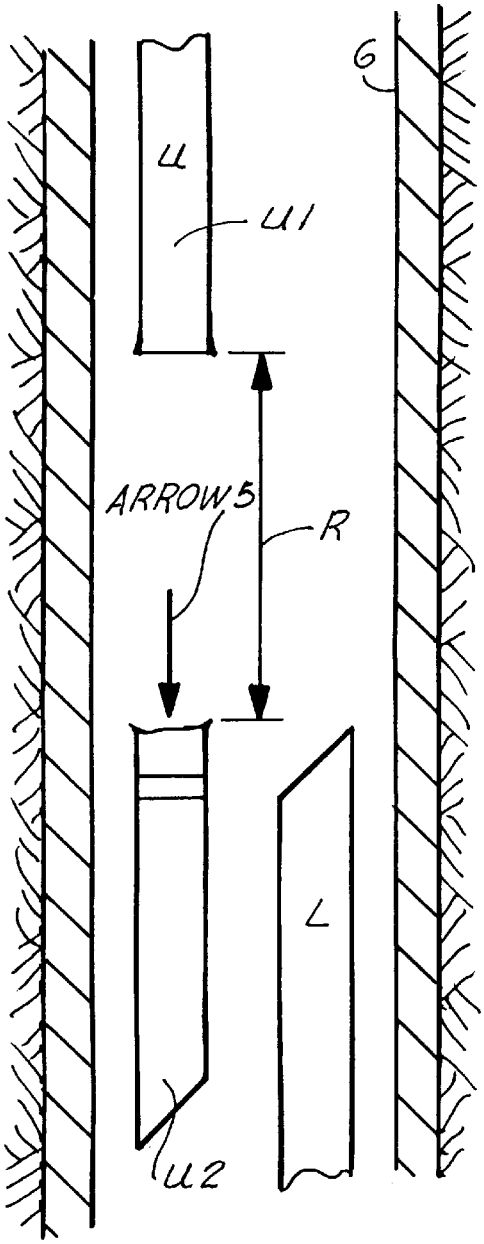

Upper down hole portion U is sealed via plug G, as best seen in FIG. 3, a predetermined distance below the earths surface but above cut line A–B. For example plug G may be inserted 60 feet above cut line A–B wherein the distance in the well borehole from plug G to the bottom of upper downhole portion defines at least the region R in well borehole to be devoid of downhole pipe P, as best seen in FIG. 15. Plug G is a bridge plug set in downhole pipe via a conventional setting tool assembly. Setting a plug such as a bridge plug is well known in the art for the purpose of sealing portions of downhole pipe.

Referring again to the method of the present invention, plug G is set at a predetermined distance such that wherein the distance in the well borehole from plug G to the bottom of upper downhole portion defines at least the region R in well borehole to be devoid of downhole pipe P.

Second cutting tool 40 is seen positioned above plug G. Second cutting tool 40 serves to cut and sever the upper downhole pipe portion U above plug G thereby forming top portion U1 and bottom portion U2, as best seen in FIG. 15. As second cutting tool 40 severs the upper downhole pipe portion U, the force of gravity acting on bottom portion U2 having plug G coupled therein and the explosive force produced by second cutting tool 40 above plug G forces bottom portion U2 to jettison downward in tubular casing 6. As bottom portion U2 jettisons downward in the well borehole, bottom portion U2 becomes somewhat parallel aligned in the well borehole, as best seen in FIG. 15, with lower downhole pipe portion L.

Second cutting tool 40 is generally comprised of elongated housing 41, endcap 42, and means for severing upper downhole pipe portion U. Elongated housing 41 has two open ends 44 and 45 which are threaded for connecting to other elongated housings (NOT SHOWN) or with respect to end 45 to endcap 42. A plurality of apertures 46, preferably six, are located around elongated housing 41 and are spaced 60° apart (thus forming three transverse bores through housing 41). Apertures 46 are staggered in different horizontal and vertical planes around elongated housing 41. Stabilizers 47 extend through each of the transverse bores formed by apertures 46 to keep second cutting tool 40 centralized within top portion U1 of upper downhole pipe portion U. Elongated housing 41 is preferably cylindrical in shape. Also preferable is that apertures 46 are located near the midpoint (lengthwise) of elongated housing 41. Stabilizers 47 are preferably rubber fingers which are slightly larger than the diameter of the bores formed by apertures 46 so that there is a snug fit.

Endcap 42 has open end 55 and closed end 56, as best seen in FIG. 3. Open end 55 of endcap 42 threadedly connects to open end 45 of elongated housing 41 such that when second cutting tool 40 is positioned above plug G, endcap 42 is below elongated housing 41. Endcap 42 is preferably cylindrical in shape and rounded or snub-nosed on closed end 56. Nevertheless, endcap 42 may be squared. In the preferred embodiment, second cutting tool 40 is a jet cutter, which are well known in the art.

Figure 2:
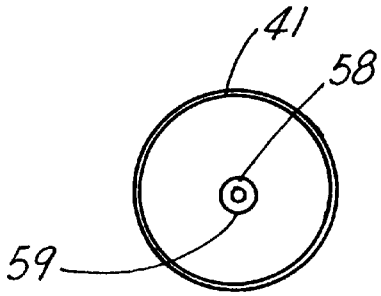
FIG. 2 is a top cross-sectional view of the embodiment of FIG. 1 taken along the plane of 2—2 of FIG. 1.

Means for severing bindingly contacted downhole pipe P is located inside elongated housing 41 and endcap 42 of second cutting tool 40. Severing means includes explosive charge 57 and electrical cable 58. Explosive charge 57 is contained within endcap 42, as best seen in FIG. 1. Electrical cable 58 runs through the inside of elongated housing 41 and endcap 42 and connects to explosive charge 57, as best seen in FIGS. 1 and 2. Electrical cable 58 is surrounded by a layer of insulation 59 and is also connected to a source of electrical power (NOT SHOWN) normally at the surface. Electrical power source (NOT SHOWN) generates an electrical pulse which electrical cable 58 transmits to explosive charge 57, causing explosive charge to detonate, as is well known to those skilled in the art.

Conventionally, jet cutters are lowered down the downhole pipe P and is suspended therein via flexural supports made of metal. Such flexural supports are secured via screws which have on occasion sheared as a result of the explosion to cut or sever the pipe. As a result, the jet cutter or other cutters using explosives can become trapped in the downhole pipe. Therefore, the flexible properties of my preferably rubber stabilizers 47 prevents stabilizers 47 from trapping second cutting tool 40 after the explosive force.

Referring again to the method of severing of the present invention, in operation second cutting tool 40 is positioned above plug G in upper downhole pipe portion U such that endcap 42 is just above plug G. An electrical an pulse is generated from the surface, which electrical cable 58 transmits to explosive charge 57, causing explosive charge 57 to detonate. The detonated explosive charge 57 exits second cutting tool 40 with a force sufficient to sever upper downhole pipe portion U above plug G and propel (jettison) bottom portion U2 having plug G therein down in the direction of ARROW 5. Thereby region R, as best seen in FIG. 15, is formed in the well borehole devoid of downhole pipe P.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method of severing a downhole pipe for forming a region in a well borehole devoid of downhole pipe comprises the method steps of:

(a) severing, at an angle, by a first cutting tool the downhole pipe to form an upper downhole pipe portion and a lower downhole pipe portion to form a sloped cut line;

(b) releasing potential energy stored in the upper downhole pipe portion and the lower downhole pipe portion;

(c) inserting a plug to seal an up-hole portion of the upper downhole pipe portion;

(d) cutting the up-hole portion via a second cutting tool above said plug into an upper piece and a lower piece; and, (e) jettisoning the lower piece downward wherein as the lower piece jettisons downward the region in the well borehole devoid of downhole pipe is formed.

2. The method of claim 1, wherein the step of (c) further comprises:

(i) lowering a separating tool to a predetermined location;

(ii) activating said separating tool;

(iii) producing an explosive force for releasing unexpended potential energy in the upper downhole pipe portion and the lower downhole pipe portion; and, (iv) simultaneously shattering said separating tool.

3. The method of claim 2, wherein prior to the step of (i) controlling the orientation of the separating tool.

4. The method of claim 1, further comprises: the method step of orientating the first cutting tool into a predetermined position in the down hole pipe prior to the step of (a).

5. The method of claim 1, further comprises the method step of creating an unobstructed path on the side of the lower downhole pipe portion.

6. The method of claim 5, wherein the step of (e) further comprises aligning the jettisoning lower piece in substantial parallel alignment with said lower downhole pipe portion.

7. A method of severing a downhole pipe in a well borehole wherein said well borehole is drilled at an angle of inclination comprises the method steps of:

(a) controlling the orientation of a first cutting tool;

(b) severing a downhole pipe to form an upper downhole pipe portion and a lower downhole pipe portion;

(c) releasing potential energy stored in the upper downhole pipe portion and the lower downhole pipe portion;

(d) inserting a plug to seal an up-hole portion of the upper downhole pipe portion;

(e) cutting the up-hole portion via a second cutting tool above said plug into an upper piece and a lower piece; and, (f) jettisoning the lower piece downward wherein as the lower piece jettisons downward the region in the well borehole devoid of downhole pipe is formed.

8. The method of claim 7, wherein the step of (c) further comprises (i) lowering a separating tool to a predetermined location;

(ii) activating said separating tool;

(iii) producing an explosive force for releasing unexpended potential energy in the upper downhole pipe portion and the lower downhole pipe portion; and, (iv) simultaneously shattering said separating tool.

9. The method of claim 8, wherein prior to the step of (i) controlling the orientation of the separating tool.

10. The method of claim 7, further comprises the method step of creating an unobstructed path on the side of the lower downhole pipe portion.

11. The method of claim 10, wherein the step of (e) further comprises aligning the jettisoning lower piece in substantial parallel alignment with said lower downhole pipe portion.

* * * * *